US007588199B2

(12) United States Patent
Huffman

(10) Patent No.: US 7,588,199 B2
(45) Date of Patent: Sep. 15, 2009

(54) BUILD-UP RESISTANT AIR ATOMIZING SPRAY NOZZLE ASSEMBLY

(75) Inventor: David C. Huffman, Merrimack, NH (US)

(73) Assignee: Spraying Systems Co., Wheaton, IL (US)

( * ) Notice: Subject to any disclaimer, the term of this patent is extended or adjusted under 35 U.S.C. 154(b) by 39 days.

(21) Appl. No.: 11/660,886

(22) PCT Filed: Aug. 25, 2005

(86) PCT No.: PCT/US2005/030147

§ 371 (c)(1),
(2), (4) Date: Feb. 23, 2007

(87) PCT Pub. No.: WO2006/026312

PCT Pub. Date: Mar. 9, 2006

(65) Prior Publication Data

US 2008/0006722 A1 Jan. 10, 2008

Related U.S. Application Data

(60) Provisional application No. 60/604,310, filed on Aug. 25, 2004.

(51) Int. Cl.
*B05B 7/12* (2006.01)

(52) U.S. Cl. ..... 239/416.5; 239/417.3; 239/427; 239/290; 239/548; 239/432

(58) Field of Classification Search ..... 239/403, 239/405, 408, 416.5, 417.3, 417.5, 429, 430, 239/432, 433, 601
See application file for complete search history.

(56) References Cited

U.S. PATENT DOCUMENTS

| | | | | |
|---|---|---|---|---|
| 3,304,014 | A * | 2/1967 | Hancock et al. | 431/349 |
| 4,518,120 | A * | 5/1985 | Johnson | 239/424 |
| 4,890,793 | A | 1/1990 | Fuglistaller et al. | |
| 5,271,562 | A * | 12/1993 | Myers et al. | 239/290 |
| 5,732,885 | A | 3/1998 | Huffman | |
| 6,276,615 | B1 * | 8/2001 | Scholz | 239/424 |

* cited by examiner

*Primary Examiner*—Dinh Q Nguyen
(74) *Attorney, Agent, or Firm*—Leydig, Voit & Mayer, Ltd.

(57) ABSTRACT

A spray nozzle assembly is provided. The spray nozzle assembly includes a nozzle body having a liquid passage that terminates in a nozzle body orifice. The spray nozzle assembly includes an impingement element having an impingement surface spaced from the nozzle body orifice. One or more air outlet orifices are disposed upstream of the impingement surface and oriented to discharge a substantially tubular curtain of air around the nozzle body orifice. An air cap defines a chamber extending around and downstream of the impingement surface. The air cap has a plurality of discharge orifices. At least one of the discharge orifices in the air cap has an associated nipple that is integrally connected to the air cap and extends the discharge orifice outwardly away from an outer face of the air cap.

12 Claims, 3 Drawing Sheets

BUILD-UP RESISTANT AIR ATOMIZING SPRAY NOZZLE ASSEMBLY

CROSS-REFERENCE TO RELATED APPLICATIONS

This patent application claims the benefit of U.S. Provisional Patent Application No. 60/604,310, filed Aug. 25, 2004.

FIELD OF THE INVENTION

This invention generally pertains to a spray nozzle for atomizing and spraying liquid and, more particularly, to internal mix air atomizing spray nozzle assemblies in which the liquid is atomized by pressurized air which is mixed with the liquid internally of the spray nozzle.

BACKGROUND OF THE INVENTION

Slurries of hydrated lime are often sprayed into the discharging flue gases from coal powered furnaces or boilers, such as in electric power plants, for the purpose of capturing, reacting with and removing sulfur dioxide from the gases prior to discharge to the atmosphere. The lime reacts with the gaseous sulfur dioxide forming particles of calcium sulfite or sulfate (gypsum). These particles are then collected on baghouse filters or electrostatic precipitators.

The hydrated lime slurry is generally sprayed into the flue gas ductwork using air atomized spray nozzle assemblies. To effectively scrub sulfur dioxide from such gases it is necessary that the slurry be finely atomized into small liquid droplets of a desired size. It is important that the spray nozzles consistently produce spray drops of the desired size in order to ensure that all of the drops evaporate in the flue gas before the gas reaches the filters or precipitator. If the drops are too large, moisture can build-up in the filters or the precipitator producing sludge that must be cleaned out on a regular basis thereby increasing maintenance costs. Moreover, the moisture can lead to corrosion of the equipment.

When air atomizing nozzles are used in flue gas desulfurization applications, lime deposits can build-up on the exposed surfaces of the air cap. This build-up is caused by a low-pressure area created by the atomized fluid discharging at a high velocity from the nozzle. The fine droplets produced by the atomization process can be captured in the entrained air that is drawn to the low-pressure air. The captured droplets accumulate on the air cap face around the exit orifices and dry forming lime deposits. The lime deposits build up in layers or beard on the air cap face and eventually can interfere with the spray nozzle performance. In particular, the lime deposits can cause the spray nozzle to produce larger drops that will not completely evaporate in the flue gases leading to a build-up of moisture in the downstream filter or precipitator.

BRIEF SUMMARY OF THE INVENTION

The invention provides a spray nozzle assembly for atomizing and spraying liquid into the atmosphere. The spray nozzle assembly includes a nozzle body having a liquid passage that terminates in a nozzle body orifice for high velocity discharge of a stream of liquid. The spray nozzle assembly includes an impingement element having an impingement surface spaced from the nozzle body orifice for breaking up such a stream of liquid impinging thereon into a laterally spreading dispersion of such liquid. One or more air outlet orifices are disposed upstream of the impingement surface and oriented to discharge a substantially tubular curtain of air around the nozzle body orifice in a downstream direction at high velocity to surround such stream from the nozzle body orifice to the impingement surface and to strike the liquid while in such a laterally spreading dispersion to further atomize such liquid. An air cap defines a chamber extending around and downstream of the impingement surface. The air cap has a plurality of discharge orifices disposed circumferentially about the impingement surface and communicating directly between the chamber and ambient atmosphere through which the mixture of air and atomized liquid particles resulting from the impingement of such stream on the impingement surface and the striking of such liquid dispersion by such high velocity air is discharged from the chamber. At least one of the discharge orifices in the air cap has an associated nipple that is integrally connected to the air cap and extends the discharge orifice outwardly away from an outer face of the air cap.

DETAILED DESCRIPTION OF THE INVENTION

Figure 1:
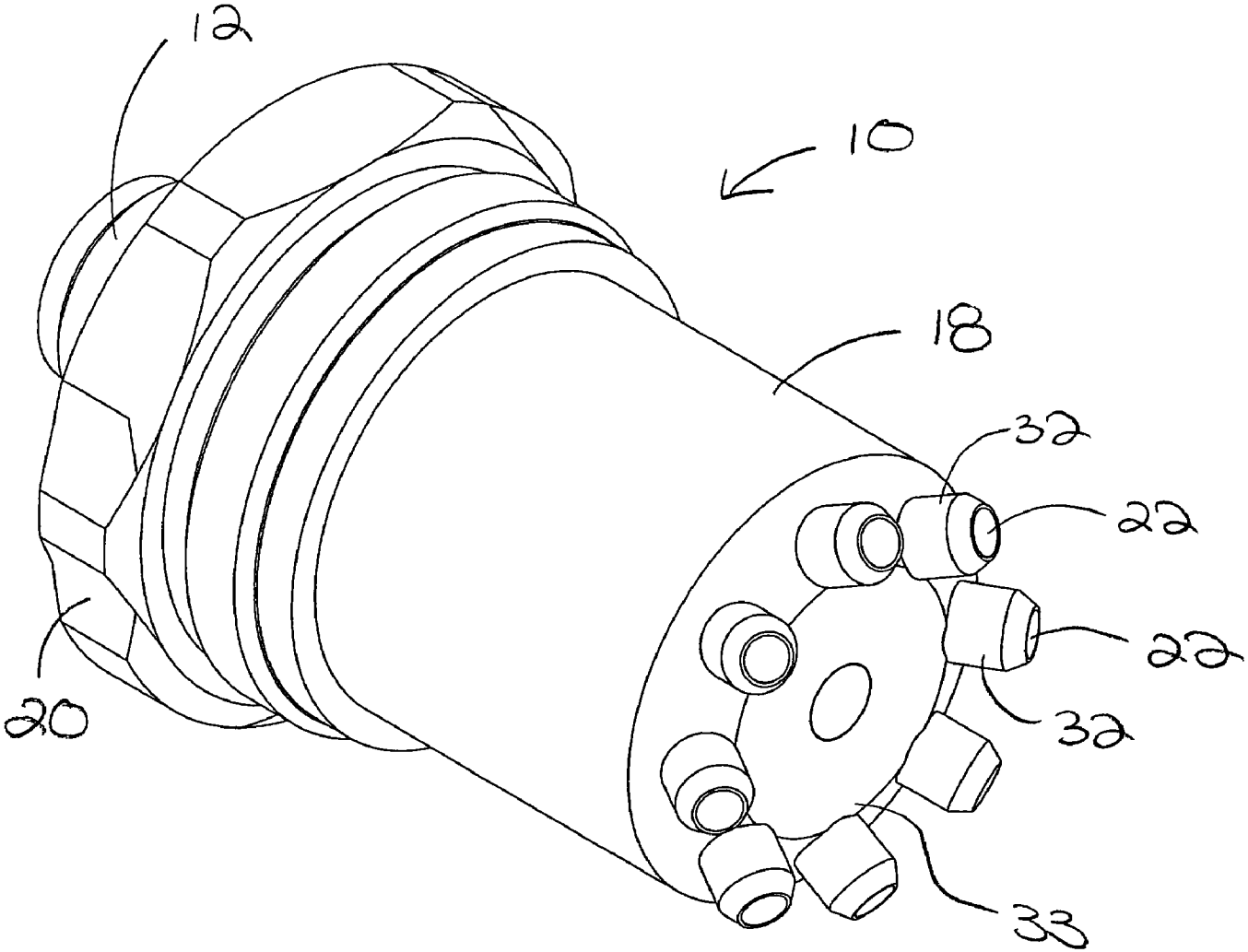
FIG. 1 is a perspective view of an illustrative spray nozzle assembly according to the present invention.
Figure 2:
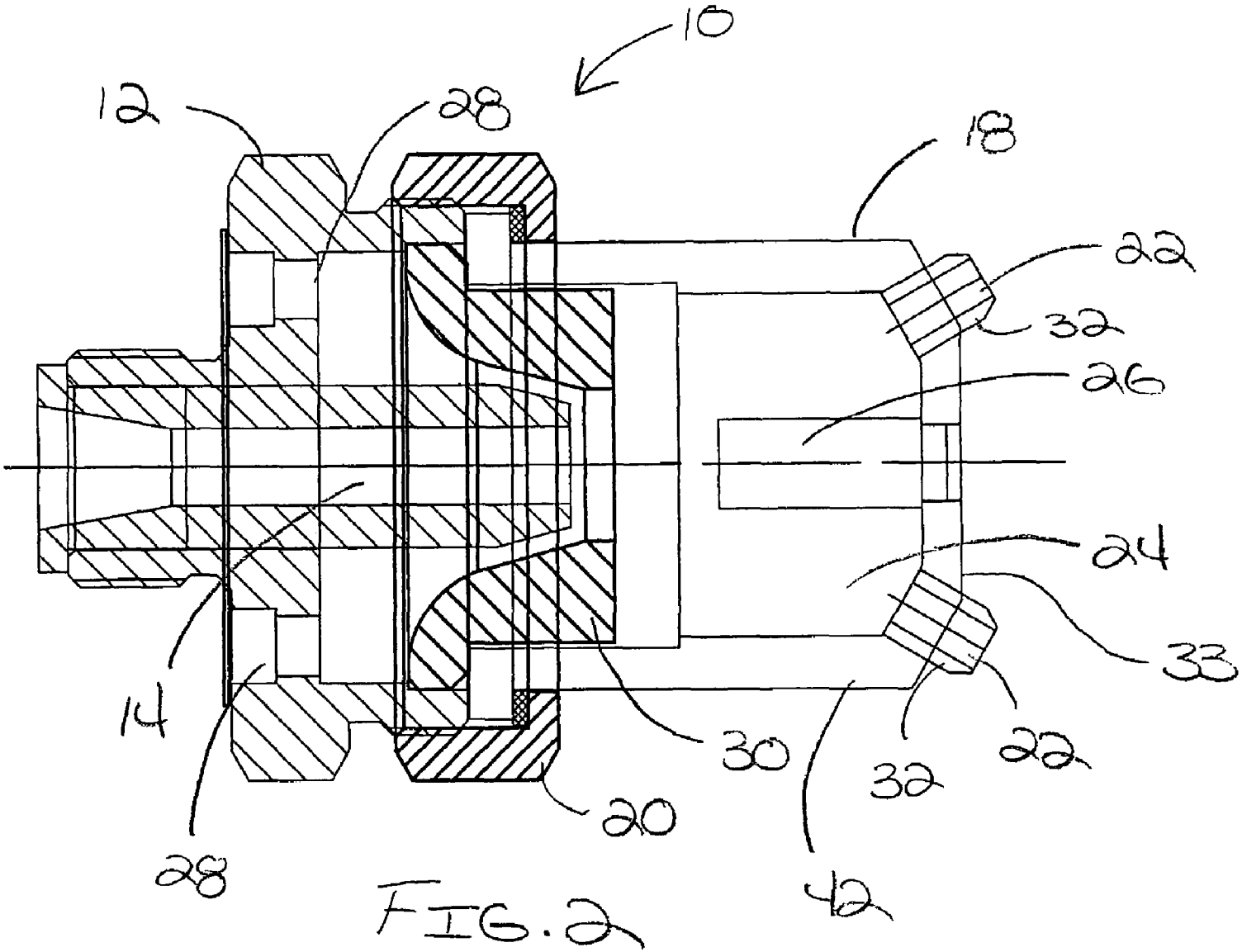
FIG. 2 is a longitudinal section view of the spray nozzle assembly of FIG. 1.

Referring now to FIGS. 1 and 2 of the drawings, there is shown an illustrative air atomizing spray nozzle assembly 10 constructed in accordance with the present invention. The illustrated spray nozzle assembly 10 is particularly adapted for discharging atomized lime slurry into a flue gas duct of, for example, a coal fired furnace or boiler for the purpose of removing sulfur dioxide from the flue gases. In this case, the spray nozzle assembly 10 includes a nozzle body 12 that is adapted for connection to a pressurized lime slurry or other fluid source as well as connection to a pressurized air source.

The nozzle body 12 includes a central longitudinally extending fluid passage 14 through which the pressurized fluid is transmitted. Additionally, an air cap 18 is arranged downstream of the nozzle body 12 and removably attached thereto by a coupling nut 20. As best shown in FIG. 1, the downstream end of the air cap 18 is generally frustoconical in shape and includes a plurality of discharge orifices 22. In this case, the discharge orifices are angled slightly outward relative to the longitudinal axis of the air cap (see FIGS. 2 and 3).

Prior to discharge, the pressurized fluid is atomized in multiple stages in the spray nozzle assembly 10. In the first stage, fluid from the central fluid passage 14 in the nozzle body 12 discharges into an expansion chamber 24 defined by the air cap 18 and strikes an impingement pin 26 (see FIG. 2). The impingement pin 26 is arranged in the expansion chamber 24 and has a flat end surface that is positioned opposite where the central fluid passage 14 exits into the nozzle body 12. Upon exiting the central fluid passage 14, the pressurized fluid strikes the pin 26 and is broken into small particles.

A plurality of air passages 28 are formed in the nozzle body 12 in encircling relation to the central fluid passage. These air passages 28 discharge into an air guide 30 (see FIG. 2)

arranged in the air cap 18 which contracts the jets of air from the air passages into a tubular curtain which surrounds the liquid stream as the liquid stream impinges against the pin 26. Thus, in the second atomization stage, the liquid particles atomized by the pin 26 are struck by the tubular curtain of air further atomizing the liquid particles. A third stage of atomization occurs when the fluid/air mixture is discharged from the expansion chamber 24 through the discharge orifices 22. Additional details regarding the construction and operation of the air atomizing features of the illustrated nozzle body 12 and air cap 18 are disclosed in U.S. Pat. No. 5,732,885, which is assigned to the assignee of the present invention and the disclosure of which is incorporated herein by reference.

Figure 3:
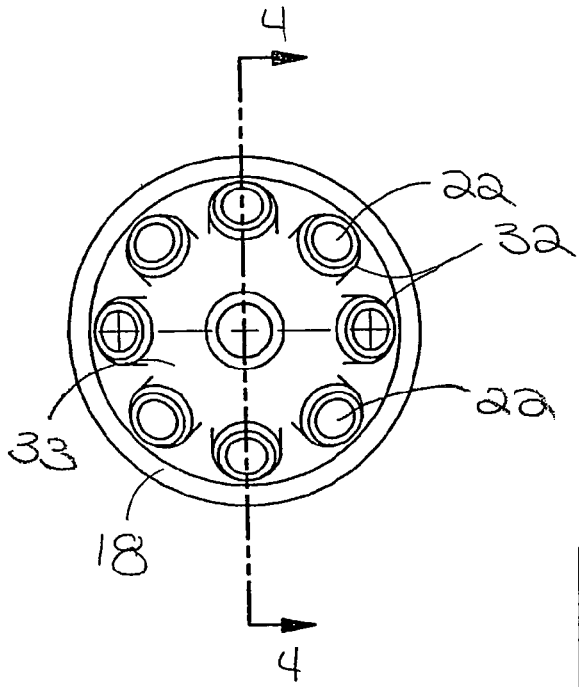
FIG. 3 is an end view of the air cap of the spray nozzle assembly of FIG. 1.
Figure 4:
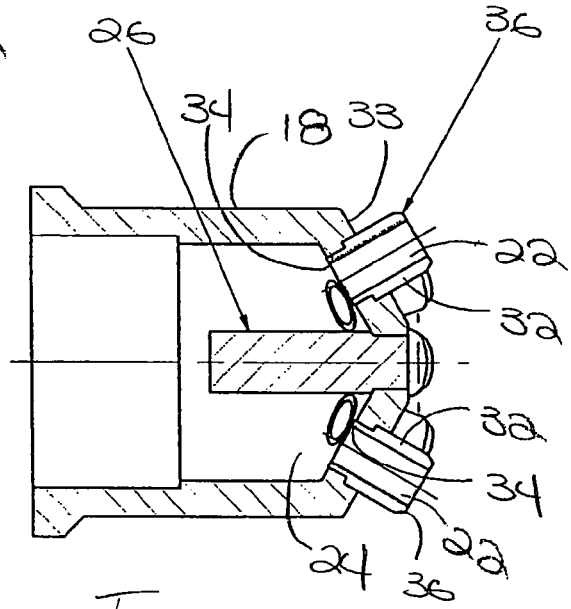
FIG. 4 is a longitudinal section view of the air cap of FIG. 3 taken in the plane of the line 4-4 in FIG. 3.
Figure 5:
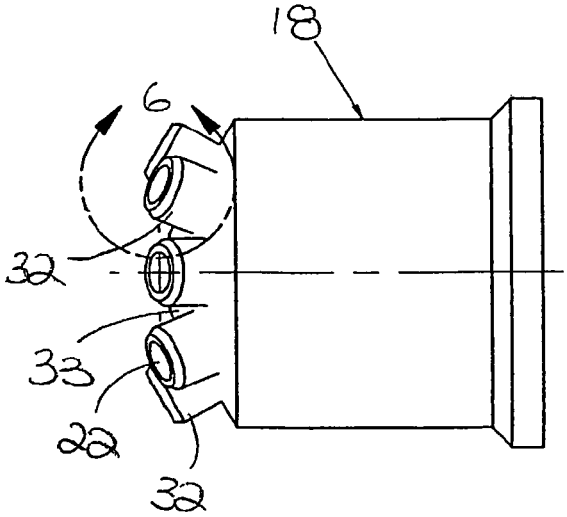
FIG. 5 is a side view of the air cap.

According to an important aspect of the present invention, in order to prevent a build-up of lime deposits on the air cap 18, each of the discharge orifices 22 in the air cap has an associated nipple 32 that is integrally connected to the air cap and extends the discharge orifice outwardly away from the outer face 33 of the air cap (see FIGS. 2-4). Extending the discharge orifices 22 away from the outer surface 33 of the air cap 18 moves any low-pressure area created by the discharging fluid away from the outer surface of the air cap. This helps reduce the likelihood that droplets entrained in the low-pressure area will build-up or beard on the outer surface 33 of the air cap 18. As shown in FIG. 4, each nipple 32 has a generally tubular configuration having an upstream end 34 in communication with the expansion chamber 24 in the air cap 18 and a downstream end 36 defining the respective discharge orifice 22. According to one preferred embodiment, the length of each nipple 32 can be approximately 1½ to 2 times the diameter of the discharge orifice opening.

Figure 6:
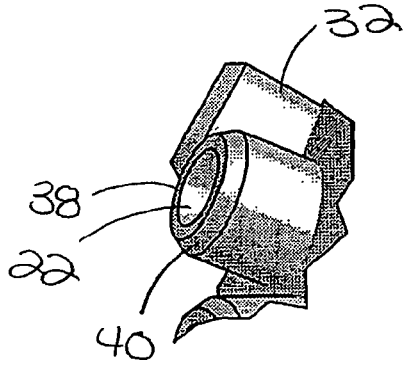
FIG. 6 is an enlarged view of a pair of the nipples of the air cap.

To further reduce the formation of lime deposits, the downstream end 36 of the nipple 32 around the discharge orifice 22 can be configured so as to minimize the surface area available for the formation of the lime deposits. As shown in FIG. 6, in the illustrated embodiment, the downstream end 36 of the nipple 32 includes a land area 38 on the inside portion of the edge adjacent the discharge orifice 22 and a tapered surface 40 extending outward from the land area 38 and angling back towards the outer surface 33 of the air cap 18. The tapered surface 40, according to one preferred embodiment, can be at an approximately 15° to 30° angle with respect to the longitudinal axis of the nipple 32. On the other hand, in the illustrated embodiment, the land areas defined by the inwardly tapered surface 40 of the nipple have a surface area less than the cross-sectional area of the tubular body of the nipple upstream of the discharge orifice.

Advantageously, the combination of the land portion 38 and the tapered surface 40 provides a relatively robust construction while minimizing the available surface area for lime deposits. The robust construction of the nipple 32 facilitates the use of more wear resistant, but relatively brittle, materials such as a ceramics for the air cap 18. Ceramic materials are generally preferred in flue gas desulfurization applications involving the discharge of lime slurry because of their high abrasion resistance. In contrast to the robust configuration provided by the land and tapered portions 38, 40, a nipple configured with a sharp knife-edge at the downstream end can be subject to cracking when using brittle materials such as ceramics.

As compared to nipples that include separate elements that are threaded or otherwise removably connected to the air cap, the integrally connected nipple 32 of the present invention provides a smooth, unobstructed path for the discharging slurry that helps prevent clogging problems. The air cap shell 42, pin 26 and nipples 32 can be manufactured in a single piece such as by molding. For example, the air cap 18 can be made of a ceramic nitride-bonded silicon carbide material that can be poured or injected into a mold, cast in the desired shape and then fired to achieve the final part. Alternatively, the air cap shell 42, pin 26 and nipples 32 could be machined as separate parts from silicon carbide in its green state. The parts could be assembled together and then fired to create a one-piece, integrally constructed air cap. Similarly, the air cap shell 42, pin 26 and nipples 32 could be molded as separate parts, assembled together and then fired to create a one-piece, integrally constructed air cap.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray nozzle assembly for atomizing and spraying liquid into the atmosphere comprising:

a nozzle body having a liquid passage that terminates in a nozzle body orifice for high velocity discharge of a stream of liquid;

an impingement element having an impingement surface spaced from the nozzle body orifice for breaking up such a stream of liquid impinging thereon into a laterally spreading dispersion of such liquid;

one or more air passage disposed upstream of the impingement surface and oriented to discharge a substantially tubular curtain of air around the nozzle body orifice in a downstream direction at high velocity to surround such stream from the nozzle body orifice to the impingement surface and to strike the liquid while in such a laterally spreading dispersion to further atomize such liquid an air cap which defines a chamber extending around and downstream of the impingement surface, the air cap having a plurality of discharge orifices disposed circumferentially about the impingement surface and communicating directly between the chamber and ambient atmosphere through which the mixture of air and atomized liquid particles resulting from the impingement of such stream on the impingement surface and the striking of such liquid dispersion by such high velocity air is discharged from the chamber;

said discharge orifices each being defined by a respective nipple that locates said discharge orifice outwardly away from an outer face of the air cap, said nipples and air cap having an integral one-piece ceramic construction, and said nipples each defining a smooth uninterrupted flow passage between said chamber and the respective discharge orifice.

2. The spray nozzle assembly according to claim 1 wherein the nipple has a substantially tubular configuration with an upstream end in communication with the chamber in the air cap and a downstream end defining the respective discharge orifice.

3. The spray nozzle assembly according to claim 1 wherein the nipple has a length that is approximately 1.5 to approximately 2 times a diameter of the discharge orifice.

4. The spray nozzle assembly according to claim 1 wherein a downstream end of the nipple has a tapered surface that angles towards the outer face of the air cap as the tapered surface extends away from the discharge orifice.

5. The spray nozzle assembly according to claim 4 wherein the tapered surface extends at an angle of approximately 15 degrees to approximately 30 degrees with respect to a longitudinal axis of the nipple.

6. The spray nozzle assembly according to claim 4 in which each nipple has a tubular body, and said downstream end of the nipple having a land area between said tapered surface and discharge orifice which has a surface area less than a cross sectional wall area of the tubular body upstream of said discharge orifice.

7. The spray nozzle assembly according to claim 6 wherein the land area is disposed inward of the tapered surface at an edge of the discharge orifice and the tapered surface extends outward from the land area.

8. The spray nozzle assembly according to claim 6 in which said land area is substantially perpendicular to the central axis of the discharge orifice.

9. The spray nozzle assembly according to claim 1 in which said impingement element is integrally connected to said air cap.

10. The spray nozzle assembly according to claim 1 in which said discharge orifice is defined by a cylindrical bore extending longitudinally through the nipple.

11. The spray nozzle assembly according to claim 1 in which said air cap and nipples are defined by a singled molded part.

12. The spray nozzle assembly according to claim 1 in which said air cap and nipples are separate parts that are integrally fused together.

* * * * *